United States Patent [19]

Merritt

[11] 4,315,183

[45] Feb. 9, 1982

[54] SUPPORT STRUCTURE FOR HIGH VOLTAGE SUBSTRATE

[75] Inventor: Elisha B. Merritt, Sunnyvale, Calif.

[73] Assignee: Diagnostic Information, Inc., Sunnyvale, Calif.

[21] Appl. No.: 48,695

[22] Filed: Jun. 14, 1979

[51] Int. Cl.[3] ..... H01J 40/06; H01J 40/02

[52] U.S. Cl. ..... 313/94; 313/238

[58] Field of Search ..... 313/101, 102, 94

[56] References Cited

U.S. PATENT DOCUMENTS

| | | | |
|---|---|---|---|
| 3,549,229 | 12/1970 | Moegenbier | 313/94 X |
| 3,609,435 | 9/1971 | Lewis | 313/101 X |
| 3,876,897 | 4/1975 | Geyer | 313/390 |
| 4,104,516 | 8/1978 | Wang et al. | 250/213 VT |
| 4,140,900 | 2/1979 | Wang | 313/94 X |
| 4,186,302 | 1/1980 | Wang | 313/94 |

*Primary Examiner*—Robert Segal

*Attorney, Agent, or Firm*—Limbach, Limbach & Sutton

[57] ABSTRACT

A planar, high voltage substrate, such as that used in an image intensification tube, is supported within the tube envelope by means of a plurality of electrically insulated rods which are arranged in the plane of the substrate, with each of the rods being perpendicularly attached at one end to the edge of the substrate and at the distal end to the tube envelope. In the preferred embodiment the rods are removably attached to the substrate, thereby allowing various substrates to be easily interchanged during the manufacture of the image intensification tube.

5 Claims, 9 Drawing Figures

SUPPORT STRUCTURE FOR HIGH VOLTAGE SUBSTRATE

BACKGROUND OF THE INVENTION

This invention relates to image intensifier tubes and more particularly to an improved structure for supporting the high voltage substrate within an x-ray image intensifier tube.

Recently a large sized proximity type image intensifier tube has been developed and is the subject of U.S. Pat. Nos. 4,104,516 and 4,140,900. In this type of proximity image intensifier tube a scintillator-photocathode is formed on a plate which is suspended within a metallic tube envelope on insulating rods between an inwardly concave metallic input window and a phosphor output screen deposited on a glass output viewing window. A high voltage is applied to the scintillator-photocathode assembly plate through one of the insulated support rods. The high voltage potential exists between the scintillator-photocathode assembly and the metallic tube envelope. Because of the extremely high voltage applied to the scintillator-photocathode assembly plate there is the great danger of electron or corona discharge between the edge of the plate and the interior walls of the tube envelope. Such discharge is most likely at the edges of the scintillator-photocathode assembly plate which, in the device described in the above-mentioned patents, is generally disk shaped. The discharge danger is less towards the center of the plate than at its edges.

The probability of electron or corona discharge at any particular location on the plate is proportional to an exponential function of the high voltage gradient at that location. The high voltage gradient is increased at any location where the surface of the plate forms a sharp edge or point. Thus the area of attachment of the support rods potentially has a higher voltage gradient than other locations on the plate. In the tube described in the above-mentioned patents the support rods attach tangentially to the plate at locations inset from its outer, circumferential edges, i.e., on the flat surface of this plate where the high voltage gradient is less than at the plate edges.

The outside surfaces of the insulating support rods are coated with a slightly conductive material, such as chrome oxide, to bleed off the accumulated charges. The potential high voltage gradient is around or less than 20,000 volts per centimeter over the length of the support rods. Because of the potential voltages used, a certain length rod was thought necessary in order not to exceed this high voltage gradient to minimize the diameter of such high voltage image intensifier tube, however, it was thus necessary to attach rods to the high voltage place at a tangential angle, with respect to the circumference of the plate, so that the rods did not extend radially from the center line of the tube. This allowed a longer rod to be encased within the tube envelope. At the point where the support rods attached to the high voltage plate they protruded from the flat surface of the plate. This made necessary a corona shield around the edge of the plate. The use of such a corona shield and the relatively thick support rods thereby increased the length of the image intensifier tube.

The increased length of the tube increases both the weight of the tube and the height of the apparatus when it is used for fluoroscopic examination. However, a reduction in the weight of the tube allows easier and simpler construction of the fluoroscopic table and a reduction in the height, that is the length of the tube, allows easier viewing for shorter radiologists during a direct view examination.

In addition to these design problems, the prior art support structure presents a number of manufacturing problems. In the prior art substrate support design the rods were first attached to the scintillator-photocathode assembly and then the entire structure was placed within the tube. Accurate registration relative to the interior of the tube was relatively difficult and the assembling of the tube became more time consuming. Also, the welding process by which the support rods were attached was relatively time consuming and expensive. In the event that a support rod proved defective, just prior to or during the assembling of the tube, the removal and replacement of it required that the entire assembly be removed from the tube housing, thereby adding to the cost of manufacture of the tube. Still another problem was the lack of standardized parts. If the nature of the high voltage substrate was to be altered, as for example when a two stage version of the tube was developed, then different parts had to be designed to adapt to the new high voltage support structure.

SUMMARY OF THE INVENTION

The above and other disadvantages of the prior art high voltage support structure system for use in an image intensifier tube are overcome by the present invention of a plurality of electrically insulated rods which are arranged in the plane of the planar high voltage substrate with each of the rods being perpendicularly attached at one end to the edge of the substrate and at its distal end to the tube envelope.

In the preferred embodiment of the invention each of the rod ends which attaches to the substrate has a protruding pin. The support structure further includes a ring with a rounded, circumferential edge. At circumferentially spaced positions along the edge are a plurality of notched recesses for receiving the rod-pins. Covers are provided for each of the recesses. When the pin is fitted into the notch, and the cover is placed into the recess, the edge of the ring has a smooth surface to reduce the high voltage gradient at that point and thereby minimize the risk of electron or corona discharge.

In one embodiment of the invention the support structure further comprises means for removably mounting the high voltage substrate within the ring. In this embodiment the ring can be electrically conductive or can include contacts so that high voltage connections can be made to one or more of the support rods which carry conductors. In the primary embodiment of the invention, only a single one of the support rods carries an electrical conductor and the ring is electrically connected to it and to the high voltage substrate itself.

As previously mentioned, it is desireable that the support rods have a predetermined length to reduce the high voltage gradient. In the preferred embodiment, this is accomplished by providing the envelope wall of the tube with a plurality of circumferentially spaced apart openings each of which connects to a separate, radially projecting hollow sleeve which is attached to the envelope wall in communication with each such opening. The distal ends of the support rods are mounted on a cap or plug within the exterior, open end of the hollow sleeves. In this way a portion of the support rods actually projects beyond the exterior surface of the tube envelope.

By mounting the high voltage substrate in a ring which allows the substrate to be interchanged, a greater standardization of parts is achieved for different versions of the same basic image intensifier tube. Also, if a portion of the support structure or the high voltage substrate proves to be defective during assembly the entire arrangement does not have to be replaced.

Another advantage of the present construction is that it allows an easier welding assembly than in the prior art construction in which the entire high voltage substrate and support rod assembly had to be fitted at the same time.

Still another feature of the invention is that by attaching the support rods perpendicularly to the edge of the support ring, rather than at a tangent to the inner surface of the high voltage substrate as in the prior art devices, the tube length is shortened.

It is therefore an object of the present invention to provide a high voltage substrate support structure for an image intensifier tube which simplifies the assembly and the manufacture of the tube.

It is still another object of the present invention to provide a high voltage substrate support structure for an image intensifier tube which minimizes the length of the tube.

It is a further object of the invention to provide a high voltage support structure for an image intensifier tube which minimizes the danger of electron or corona discharge.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN EMBODIMENTS OF THE INVENTION

Figure 1:
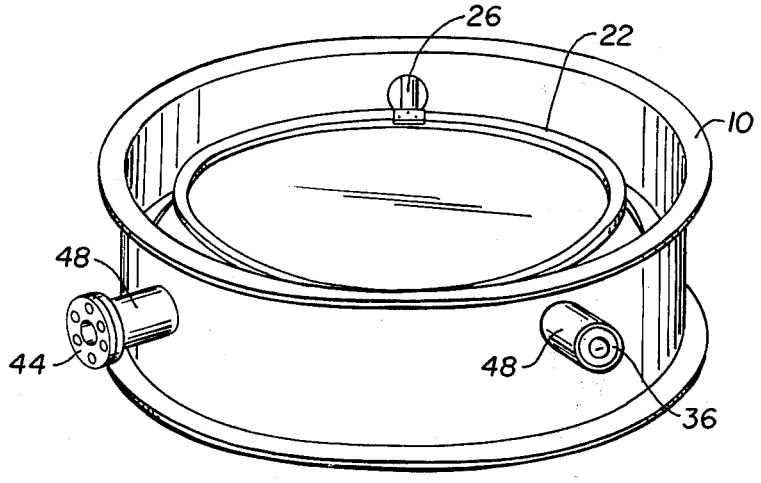
FIG. 1 is a perspective view of a portion of an image intensifier tube and envelope and the high voltage support structure according to the invention.
Figure 2:
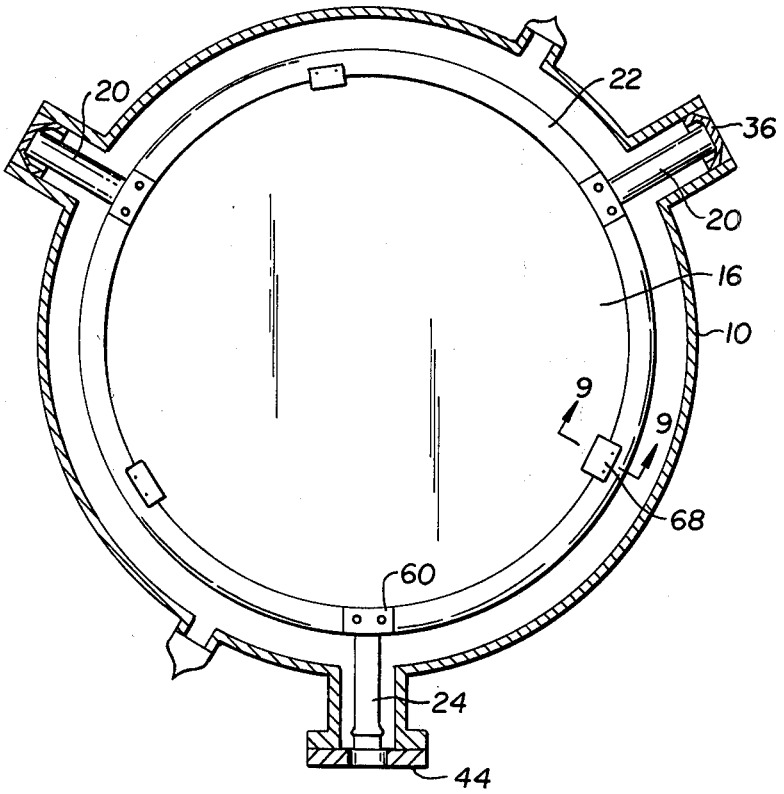
FIG. 2 is a horizontal, sectional view of the image intensifier tube envelope depicted in FIG. 1 taken perpendicularly to the longitudinal axis of the tube envelope.
Figure 3:
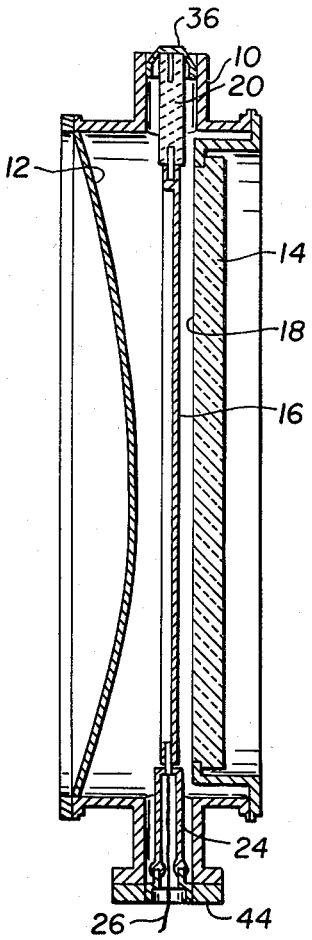
FIG. 3 is a vertical, sectional view taken generally along the lines 3—3 in FIG. 2.

Referring now more particularly to FIGS. 1 and 2, the metallic envelope 10 of a proximity type image intensifier tube is illustrated. This type of tube is described in detail in U.S. Pat. Nos. 4,104,516 and 4,140,900. As best illustrated in FIG. 3, the envelope is closed at one end by an inwardly concave metallic input window 12 and is closed at the other end by a glass window 14 upon which an output phosphor display screen is deposited. In between the windows 12 and 14 a high voltage substrate 16 is suspended which, in the single stage version of the image intensifier tube is a scintillator-photocathode assembly. The operation of the tube is described in detail in the above recited patents and therefore will not be described in further detail herein other than to note that a high voltage is applied between the high voltage substrate 16 and the output phosphor display screen 18 on the window 14.

Because the tube envelope 10 is metallic, it is necessary that the high voltage substrate 16 be suspended from it by insulators. This is accomplished in the present invention by means of a plurality of radially projecting support rods 20 which are made of electrically insulated material. The support rods are attached perpendicularly at one end to the edge of the support ring 22 and at their distal ends to the tube envelope 10.

One of the support rods 24 is hollow and encases a wire 26 connected to a high voltage source (not shown).

Figure 4:
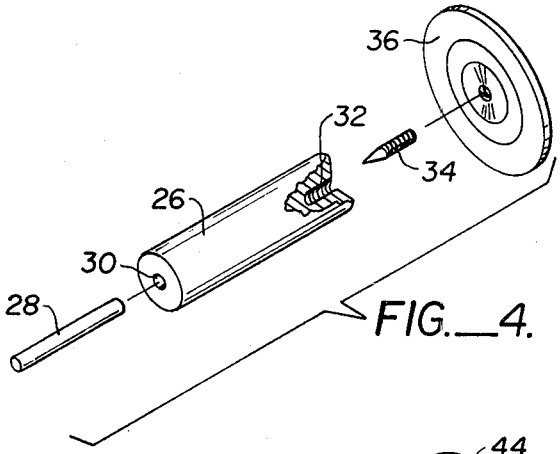
FIG. 4 is an exploded, perspective view showing the assembly of the insulating, support rods according to the invention.
Figure 5:
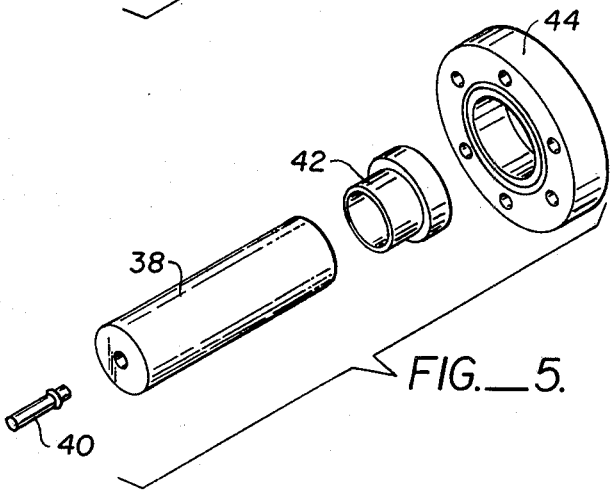
FIG. 5 is an exploded, perspective, view showing the assembly of one of the electrode input support rods according to the invention.

Referring now more particularly to FIGS. 4 and 5 the construction of the support rods 20 and 24 will be described in greater detail. The support rod 20 is comprised of a rod of insulating ceramic material 26 which has a chrome oxide coating on it to bleed off the accumulated electrostatic charges. The end of the rod 26 which is to attach to the ring 22 is fitted with an anodized aluminum pin 28 which fits into a corresponding hole 30 in the rod 26. The distal end of the rod 26 has a threaded hole 32 for receiving a threaded stud 34. The other end of the stud 34 screws into a stainless steel disk or cap 36.

The electrode carrying support rod 24 is comprised of a hollow glass tube 38 which is closed at one end and is provided with an alloy (KOVAR type) pin which matches the thermal expansion characteristics of the glass. The opposite end of the tube 38 is fitted to an alloy adaptor 42 which is welded into a flange 44.

Figure 6:
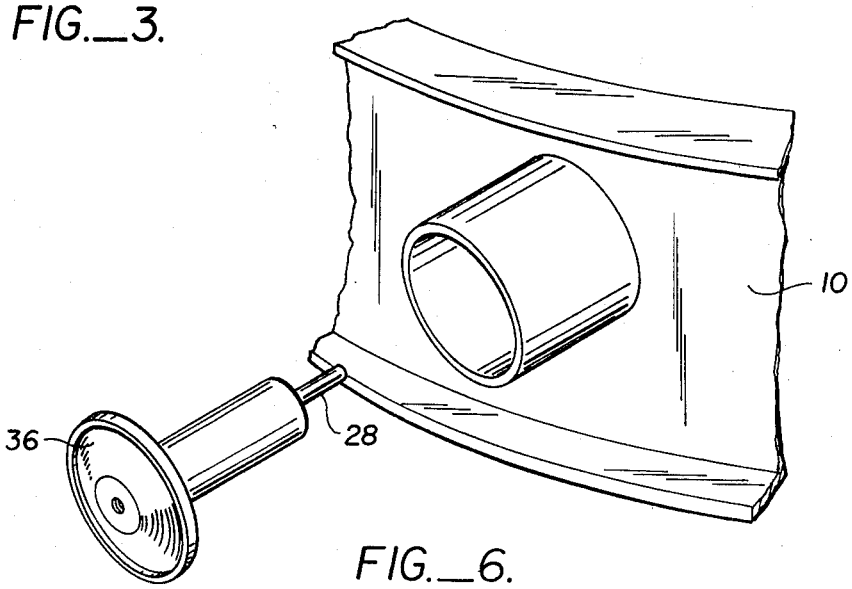
FIG. 6 is an enlarged, exploded, perspective view, with portions broken away of the image intensifier tube envelope depicted in FIG. 1 together with one of the insulating support rods.
Figure 7:
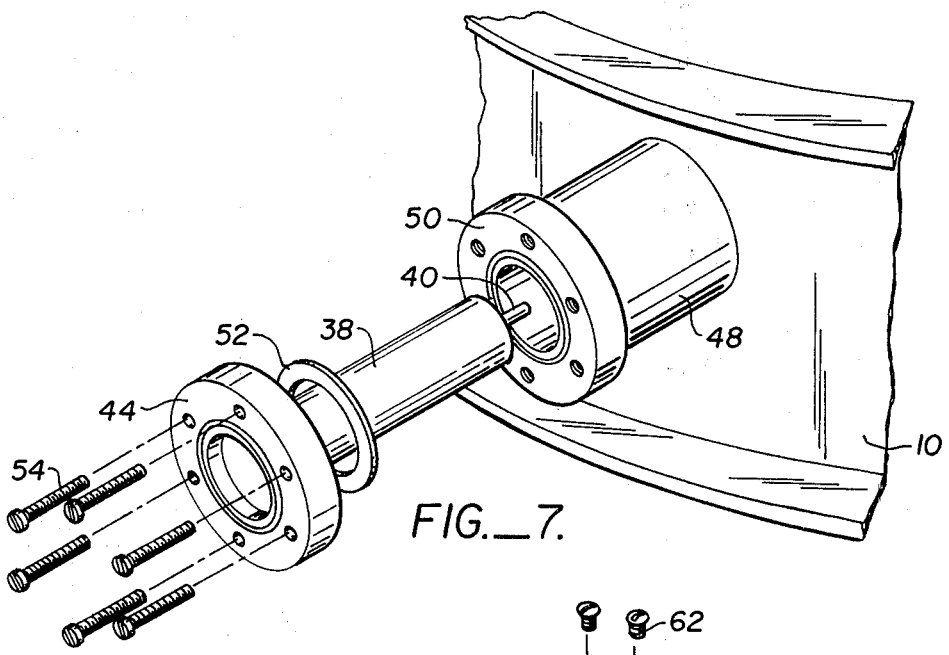
FIG. 7 is an exploded, perspective view, with portions broken away of the image intensifier tube envelope showing the assembly of the high voltage input support rod.

Referring now more particularly to FIGS. 6 and 7 it will be seen that the tube envelope 10 has a plurality of openings 46 in its exterior surface and that radially projecting tubes or sleeves 48 are joined to the exterior surface of the envelope 10 and about the edges of the openings 46. Each rod 26 is inserted coaxially within a separate one of the tubes 48 until the end cap 36 seals off the exterior end of the opening in the tube 48. The cap 36 is welded into place to seal the opening. This is best viewed in FIG. 2. The end of the tube 48 in which the electrode support tube 38 is suspended is provided with an end flange 50 which mates with the flange 44 attached to the tube 38. A copper gasket 52 seals the joint between the flanges 44 and 50 which are attached together by means of bolts 54. As with the rods 26 the tube 38 is suspended coaxially within the tube 48 to project into the interior of the tube envelope 10.

Figure 8:
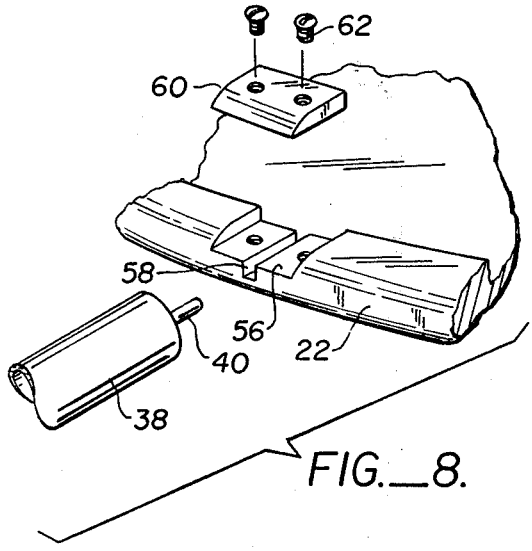
FIG. 8 is an exploded, perspective view, with portions broken away of the high voltage support ring according to the invention together with a high voltage input support rod.

Referring now more particularly to FIGS. 2 and 8, it can be seen that the edge of the ring 22 is rounded to reduce the high voltage gradient. At a plurality of circumferentially spaced part locations on the ring 22, recesses 56 are provided with notches or grooves 58 therein to receive pins 28 and 40. It will be noted that the grooves 58 are radially aligned.

Separate covers 60, also provided with rounded edges, fit in the recesses 56 so that the rounded edge of the ring 22 is uninterrupted when the covers 60 are in place. Each cover is held in its recess 56 by means of screws 62. It can be seen that the covers 60 capture the pins 28 and 40 in the grooves 58 when in place. This holds the support ring 22 suspended within the envelope 10 on the ends of the pins 28 and 40.

Figure 9:
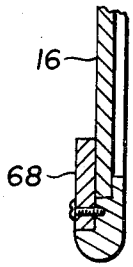
FIG. 9 is a vertical, sectional view, taken generally along the lines 9—9 in FIG. 2.

Referring now more particularly to FIGS. 2 and 9, the high voltage substrate 16 which is to be suspended by means of the ring 22 within the tube envelope 10 takes the form of a plate which may be rectangular with rounded corners or any other shape suitable for mounting within the ring 22. The actual construction of the substrate 16 will depend on the type of image intensifier tube.

In a single stage image intensifier tube of the type described in the aforementioned patent, the high voltage substrate 16 is an x-ray transmissive metal plate on which a scintillator and photocathode layers will have been deposited. In a two stage image intensifier tube the high voltage substrate can take the form of a fiber optic plate on one side of which is deposited a phosphor layer and on the other side which is deposited a photocathode layer. In such an embodiment the edge of the high voltage substrate is provided with a conductive strip so that both sides of the plate are at the same potential. In still another type of image intensifier tube the high voltage substrate can be a fiber optic plate with the photocathode layer on one side and a phosphor layer on the opposite side. In this type of high voltage substrate separate electrical contacts must be made to the opposite sides of the plate. Thus two electrode support rod assemblies 24 would be provided with electrical contacts being made to the separate sides of the high voltage plate. In such a case the support ring 22 would either be made of an insulating material or the point of contact with the support rods would be insulated.

To allow for interchangeability of the high voltage substrate 16 within the ring 22 the ring 22 is provided with a notch or shoulder at its inner circumferential edge to provide a stop for the substrate 16. A plurality of cover plates 68 fit against the opposite sides of the high voltage substrate 16 to capture it against the shoulder 66. The plates 68 are attached to the ring 22 by means of screws 70.

Thus it can be seen that the high voltage substrate is easily mounted and demounted from the support ring 22 and that the ring 22 is likewise easily mounted and demounted from the supporting rods 20, this greatly simplifies the manufacture and assembly of proximity type image intensifier tubes. Also, since the support structure is radially aligned and of a thickness which is comparable to that of the support ring and high voltage substrate the overall length of the proximity image intensifier tube is minimized.

The terms and expressions which have been employed here are used as terms of description and not of limitation, and there is no intention, in the use of such terms and expressions, of excluding equivalents of the features shown and described, or portions thereof, it being recognized that various modifications are possible within the scope of the invention claimed.

What is claimed is:

1. In a proximity type image intensifier tube of the type having an evacuated, electrically conductive envelope, an input window, an output window, an output display screen on the output window, and a high voltage photocathode carrying substrate mounted between the input window and the output display screen, an improved structure for supporting the substrate within the envelope, and for electrically isolating the substrate from the envelope, the structure comprising a plurality of electrically insulated rods arranged in the plane of the substrate, each of the rods being connected at one end to the envelope and means for connecting the distal ends of the rods to the circumference of the substrate with the rods being oriented perpendicularly to the substrate's circumference, each of the distal rod ends having a protruding pin and wherein the connecting means comprise a ring with a rounded edge for holding the substrate, the ring having a plurality of recesses about the edge for receiving the rod pins, a cover to give the edge a smooth surface while simultaneously capturing the substrate against the ring, and removable means for holding the cover in place.

2. A support structure as recited in claim 1 further comprising a conductor positioned within one of the rods and extending along its length, the conductor being electrically connected to the photocathode for supplying a high voltage potential thereto relative to the tube envelope and the display screen.

3. In a proximity type image intensifier tube of the type having an evacuated, electrically conductive envelope, an input window, an output window, an output display screen on the output window, and a high voltage photocathode carrying substrate mounted between the input window and the output display screen, an improved structure for supporting the substrate within the envelope, and for electrically isolating the substrate from the envelope, the structure comprising a plurality of electrically insulated rods arranged in the plane of the substrate, each of the rods being connected at one end to the envelope and means for connecting the distal ends of the rods to the circumference of the substrate with the rods being oriented perpendicularly to the substrate's circumference, each of the distal rod ends having a protruding pin and wherein the connecting means removably connect the rods to the substrate and comprise a ring with a rounded edge for holding the substrate, the ring having a plurality of notched recesses about the edge for receiving the rod pins, covers for each of the recesses to give the edge a smooth surface at each of the recesses, and removable means for holding the covers in place.

4. A support structure as recited in claim 3 wherein the substrate is removably mounted on the ring.

5. A support structure as recited in claim 1 wherein the envelope wall has a plurality of circumferentially spaced apart openings therein, and further comprising a plurality of radially, outwardly projecting, hollow sleeves, each attached to the envelope wall in communication with a separate one of the openings therein, and separate means for mounting the one end of each support rod within the hollow sleeves.

* * * * *